United States Patent [19]

Hellat

[11] Patent Number: 4,761,958

[45] Date of Patent: Aug. 9, 1988

[54] FUEL LANCE FOR THE COMBUSTION CHAMBER OF A GAS TURBINE

[75] Inventor: Jaan Hellat, Baden-Rütihof, Switzerland

[73] Assignee: BBC Brown, Boveri & Company, Ltd., Baden, Switzerland

[21] Appl. No.: 802,604

[22] Filed: Nov. 25, 1985

Related U.S. Application Data

[63] Continuation of Ser. No. 596,607, Apr. 4, 1984, abandoned.

[30] Foreign Application Priority Data

Apr. 13, 1983 [CH] Switzerland ..... 1988/83

[51] Int. Cl.[4] ..... F02C 1/00

[52] U.S. Cl. ..... 60/737

[58] Field of Search ..... 60/737, 740, 741, 738, 60/742, 749

[56] References Cited

U.S. PATENT DOCUMENTS 2,775,484 12/1956 Fox ..... 60/741

3,234,731 2/1966 Dermody et al. ..... 60/741

3,664,124 5/1972 Fehler ..... 60/741

3,695,037 10/1972 Alverari ..... 60/741

3,726,088 4/1973 Kretschmer et al. ..... 60/741

*Primary Examiner*—Carlton R. Croyle

*Assistant Examiner*—Timothy S. Thorpe

*Attorney, Agent, or Firm*—Burns, Doane, Swecker & Mathis

[57] ABSTRACT

Self-excited vibrations can occur in the combustion chambers of gas turbines, which vibrations are due to modulation of the quantity of gaseous fuel or fuel/air mixture as the fuel is injected through a nozzle and into the combustion chamber. The modulation results from pressure fluctuations that occur in the plane of the nozzle. The new fuel lance simultaneously permits both de-coupling of the fuel line in order to avoid combustion chamber vibrations and the possibility of fuel quantity control. The fuel lance comprises an adjustable throttle body that is provided with fuel passage openings and a plunger, the penetration depth of which plunger relative to that of the throttle body is a measure of the fuel quantity flowing therethrough.

4 Claims, 1 Drawing Sheet

FUEL LANCE FOR THE COMBUSTION CHAMBER OF A GAS TURBINE

This application is a continuation of application Ser. No. 596,607, filed Apr. 4, 1984 now abandoned.

BACKGROUND AND SUMMARY OF THE INVENTION

Self-excited vibrations can occur in combustion chambers. These vibrations are due to a modulation of the quantity of gaseous fuel or fuel/air mixture injected into the combustion chamber through a nozzle, the modulation being caused by pressure fluctuations in the plane of the nozzle. The feedback circuit necessary for self-excitation is closed whenever the changes in the fuel consumption in the flame caused by the supply fluctuations satisfy a phase condition with the chamber pressure. A classical example of this is the so-called "singing flame".

Such vibrations can be dealt with, essentially, in two ways:

1. By modification of the acoustic properties, i.e., of the impedances of the fuel supply or the chamber. These measures, however, are only effective within a certain frequency band, as the impedances depend upon the frequency.

2. By acoustic decoupling of the fuel supply system through the use of an infinitely large inlet impedance. This impedance is attained by means of strong throttling of the fuel supply in the vicinity of the combustion chamber inlet, as provided for example, by sonic nozzles. This assumes that the fuel is supplied with a sufficiently high pressure, which is actually the case, or may be achieved in most cases. This measure acts independent of frequency; However, the application of this procedure does not make it possible to vary the fuel quantity over a wide range. A conventional control valve, which provides throttling and quantity adjustment, can only be applied outside of the total burner system in burners of conventional type. In this case, however, there still remains a supply system between the control valve and the combustion chamber inlet and, under certain circumstances, this supply system may participate in a vibration.

The objective of the invention is to produce a burner which combines in itself the decoupling, described above, of the fuel supply line in order to avoid combustion chamber vibrations with the possibility of controlling the quantity of fuel.

In accordance with the invention, this objective is achieved by means of a fuel lance of the type mentioned at the beginning having the characterising above.

The advantage of the invention is substantially to be seen in that a fuel lance is produced in a relatively simple manner, which fuel lance combines in itself in a compact manner both a decoupling of the fuel line in order to avoid combustion chamber vibrations and the possibility of fuel quantity control.

The decoupling is effective by virtue of the compact construction of the fuel lance, the distance between the throttle body and the nozzle outlet may be kept substantially shorter than the wavelength of typical natural vibrations of the combustion chamber system.

A further advantage of the invention is that the fuel lance may be provided with a central or radial nozzle outlet.

In the case of a supply of premixed fuel, an additional advantage of the present invention lies in the fact that the throttle body simultaneously acts as a flame trap.

Embodiment examples of the subject matter of the invention are shown in simplified form and explained in more detail below using the accompanying drawings. Those elements which are not required in order to obtain an understanding of the invention are not depicted.

DETAILED DESCRIPTION OF THE INVENTION

Figure 1:
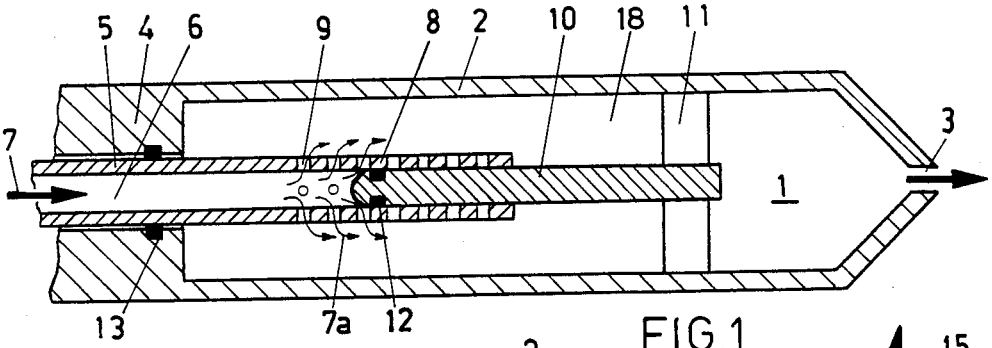
FIG. 1 shows a fuel lance with fuel supply through an inner pipe and a central nozzle outlet.

FIG. 1 shows, in a simplified manner, the concept of a fuel lance 1, which lance is a constituent part of a burner, not shown, which burner in turn is a constituent part of a combustion chamber, again not shown, of, for example, a gas turbine. The burner may, for example, be a diffusion burner with swirled air supply.

The fuel lance 1 consists of a lance pipe 2 with a central nozzle outlet 3. Upstream of the lance pipe 2, the fuel lance 1 is formed by a bush 4, in which is guided an axially adjustable tubular throttle body 5. Fuel 7 is supplied through the inside of a pipe 6. On the downstream side of the fuel lance, the pipe wall 8 in the unguided part of the throttle body 5 is provided with fuel passage openings 9 in the peripheral and in the axial direction. Both the number and the arrangement of the fuel passage opening is arbitrary; as far as the shape is concerned, holes or slots may, for example, be provided. As far as the number and size of the fuel passage openings 9 is concerned, this depends on the maximum throughput required for the particular burner. A nozzle channel 18 directs the fuel from the openings 9 to the nozzle outlet 3. The lance pipe 2 carries a plunger 10 inside the pipe 6, which plunger 10 is centrally supported within the pipe 6 of the throttle body 5 by means of struts 11, as struts are conventionally used for supporting internal bodies in cross-sections through which a fluid flow passes. A seal 12 also placed in this location ensures that the fuel passage openings 9 positioned over the plunger 10 for the given axial position of the throttle body 5 are closed in a gas-tight manner. A gas-tight seal between the throttle body 5 and the bush 4 is provided by a seal 13. The free cross-section, such as the number of fuel passage openings 9 still being used, and, therefore, the fuel quantity *7a* flowing through the fuel passage openings may be varied by axial displacement of the throttle body 5 relative to the plunger 10. The free flow cross-section therefore depends upon the penetration depth of the plunger 10 relative to the throttle body 5 at any given time. If the ratio between the fuel pressure in the supply line and the pressure at the nozzle outlet 3 exceeds a critical value, the fuel 7 flows through the fuel passage openings 9 of the throttle body 5 with sonic velocity such that pressure disturbances passing upstream from the nozzle outlet 3 no longer will influence the fuel quantity *7a* emerging from the fuel passage openings 9. With respect to design of the fuel lance, it is important to ensure that the distance between the fuel passage openings 9 and the nozzle outlet 3 or 15 is substantially shorter than the wavelength of typical natural vibrations of the combustion chamber system.

Figure 2:
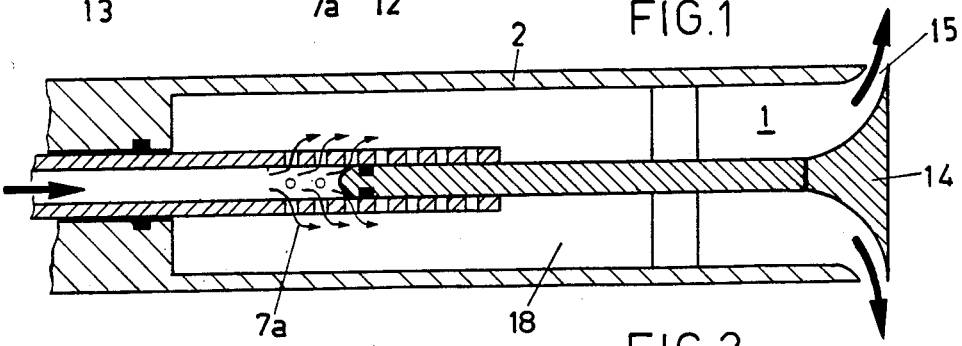
FIG. 2 shows a fuel lance with fuel supply through an inner pipe and a radial nozzle outlet.

FIG. 2, like FIG. 1, also shows a simplified representation of a fuel lance 1. This embodiment is characterised by the difference, relative to FIG. 1, of fuel flow in that the fuel quantity *7a* flowing from the fuel lance 1 now emerges radially. The lance pipe 2 remains cylindrical and open on the nozzle outlet side. The plunger 10 is extended beyond the struts 11 and carries on its end a central body 14. The opening between the end of the lance pipe 2 and the inner, outwardly-curved portion of the central body 14 forms a radial nozzle outlet 15.

Figure 3:
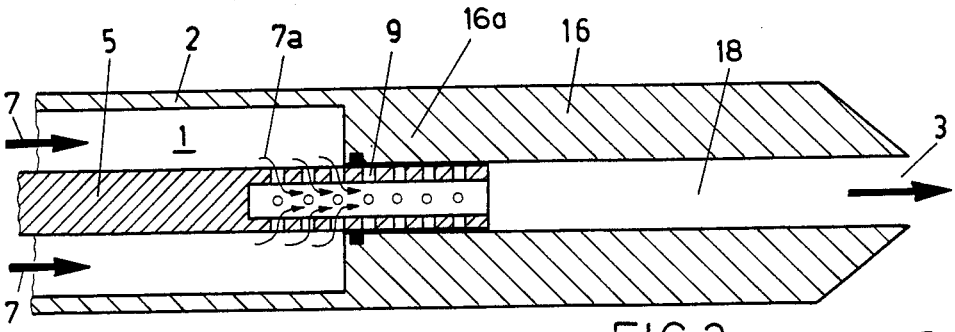
FIG. 3 shows a fuel lance with fuel supply through the lance pipe and a central nozzle outlet.

In FIG. 3, the fuel 7 is supplied directly through the fuel lance 1. The lance pipe 2 changes downstream into a bush 16 that extends as far as the central nozzle outlet 3. The throttle body 5 is a spindle which has a tubular recess or bore at one end only and only over a certain length. The fuel passage openings 9 are also located in this part. The inner diameter of the bush 16 also forms the nozzle channel 18 to the central nozzle outlet 3 and includes a bush portion 16*a* which receives the throttle body 5. The free cross-section, i.e., the number of fuel passage openings 9 still in use, and, therefore, the fuel quantity *7a* flowing therethrough may be altered by axial displacement of the throttle body 5 relative to the bush 16. The fuel 7 flows around the throttle body 5 in the region of the lance pipe portion 2. At the point of the throttle body 5 where the lance pipe 2 becomes the bush 16, the fuel flows through those fuel passage openings 9 which, because of the fuel quantity control, are still in use, i.e., those fuel passage openings which have not yet been enveloped by the bush 16. In contrast to FIGS. 1 and 2, the fuel 7, in this case, flows along the exterior of the throttle body, into the interior of the throttle body and passes therefrom to the nozzle outlet 3.

Figure 4:
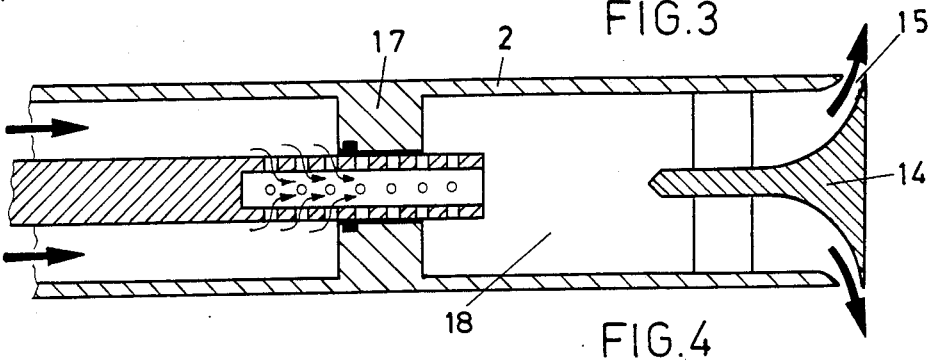
FIG. 4 shows a fuel lance with fuel supply through the lance pipe and a radial nozzle outlet.

FIG. 4 shows a lance pipe 2 open on both sides, which lance pipe is divided by a throat 17 in the center. The throat performs the same function as that of the bush portion 16*a*, described in the discussion of FIG. 3 above. The central body 14 makes possible a radial nozzle outlet 15 through which fuel passes, as discussed with the description of FIG. 2 above.

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. A fuel lance for supplying gaseous fuel to a combustion chamber of a gas turbine without interference from a natural vibration of said combustion chamber, said fuel lance comprising:

a lance pipe having an interior chamber with a nozzle outlet adjacent one end of said chamber;

a plunger in said interior chamber, means supporting said plunger at a fixed location spaced from said nozzle outlet;

a tubular throttle body, means mounting said throttle body in said lance pipe for axial movement relative to said pipe, said body extending into said interior chamber, a source of gaseous fuel and means for conducting gaseous fuel from said source to the interior of said throttle body, said plunger being received in said tubular body and said throttle body having a plurality of fuel openings spaced longitudinally along said body in said chamber through which gaseous fuel passes from the interior of said throttle body into said chamber, said plunger including means for progressively closing off predetermined members of said plurality of fuel openings according to the relative longitudinal position of said throttle body relative to said plunger, the longitudinal position of said throttle body regulating the quantity of fuel passing into said combustion chamber while limiting the position of any fuel opening relative to said nozzle outlet to a predetermined distance that is less than the wavelength of the natural vibration of the combustion chamber system.

2. The fuel lance as claimed in claim 1, wherein said means supporting said plunger includes struts extending radially from said plunger to said lance pipe, said throttle body sliding over said plunger, said means mounting said throttle body in said lance pipe including a bush at the other end of said interior chamber and a seal positioned between said bush and said throttle body.

3. A fuel lance for supplying gaseous fuel to a combustion chamber of a gas turbine without interference from a natural vibration of said combustion chamber, said sonic fuel lance comprising:

a lance pipe having an interior chamber with a nozzle outlet adjacent one end of said chamber;

a source of gaseous fuel; and a tubular throttle body, means mounting said throttle body in said lance pipe for axial movement relative to said pipe, said body extending into said interior chamber, passage means in said lance pipe to conduct gaseous fuel from said source to the exterior of said throttle body, said throttle body having a plurality of fuel openings spaced longitudinally along said body, sealing means in said chamber spaced from said nozzle outlet for progressively closing off predetermined members of said plurality of fuel openings according to the relative longitudinal position of said throttle body relative to said nozzle outlet, the longitudinal position of said throggle body regulating the quantity of fuel passing from the exterior of said throttle body into said combustion chamber while limiting the position of any fuel opening relative to said nozzle outlet to a predetermined distance that is less than the wavelength of the natural vibration of the combustion chamber system.

4. The fuel lance as claimed in claim 3, wherein said means for mounting said throttle body in said lance pipe includes a bush at the other end of said interior chamber, said throttle body having a longitudinal bore open to said interior chamber, said plurality of fuel openings communicating said passage means in said lance pipe with said bore.

* * * * *